US005458518A

United States Patent [19]

Lee

[11] Patent Number: 5,458,518

[45] Date of Patent: Oct. 17, 1995

[54] METHOD FOR PRODUCING SILICON TIP FIELD EMITTER ARRAYS

[75] Inventor: Jong D. Lee, Seoul, Rep. of Korea

[73] Assignee: Korea Information & Communication Co., Ltd., Seoul, Rep. of Korea; a part interest

[21] Appl. No.: 335,500

[22] Filed: Nov. 7, 1994

[30] Foreign Application Priority Data

Nov. 8, 1993 [KR] Rep. of Korea ..... 1993-23612

[51] Int. Cl.[6] ..... H01J 1/30; H01J 9/02

[52] U.S. Cl. ..... 445/24; 445/50

[58] Field of Search ..... 445/24, 50, 51

[56] References Cited

U.S. PATENT DOCUMENTS 5,228,878 7/1993 Komatsu ..... 445/24

5,389,026 2/1995 Fukuta et al. ..... 445/24

*Primary Examiner*—Mark Rosenbaum
*Assistant Examiner*—Jeffrey T. Knapp
*Attorney, Agent, or Firm*—Dilworth & Barrese

[57] ABSTRACT

The present invention provides for a method for manufacturing a field emitter array comprising the steps of depositing a silicon nitride mask pattern layer on the silicon substrate, forming a porous silicon layer in the substrate except in parts under the nitride mask patterns and oxidizing the porous silicon layer and the silicon substrate under the silicon layer, which results in formation of cone shape cathode tips. Further, gates corresponding to said cathode tips are provided by the conventional process or by process of depositing thin metal film and photoresist on the mask patterns and the porous silicon layer, etching the photoresist layer on the patterns, and then etching the metal film on the patterns, or by lift-off process.

9 Claims, 3 Drawing Sheets

METHOD FOR PRODUCING SILICON TIP FIELD EMITTER ARRAYS

BACKGROUND OF THE INVENTION

The present invention relates to a method for producing silicon tip field emitter arrays, and more particularly, to a method for producing silicon tip field emitter arrays of micro-triodes by using the oxidized porous silicon layer of a silicon substrate.

Recently, there have been some attention focused on micro-triodes having the same functions as conventional triodes. A field emitter array of micro-triodes is fabricated by combining emitter tips made by micro-treating a silicon substrate with corresponding gate electrodes and anodes in order to be operated in a vacuum state. The diameter of the tip apex ranges from several tens angstrom to several thousands angstrom.

Such micro-triode consists of an emitter tip of 1~2 μm in height, with a gap of 0.5~1.0 μm between the tip and the gate and a gap of 100~500 μm between the gate and the anode glass. Accordingly, the micro-triode can be formed into a thin film shaped structure.

The micro-triode may be used as an amplifier in a micro-wave region or as a switching means, and a high frequency power module can be made by combining numerous micro-triodes to an array. Also, a display panel can be constructed by combining such an array and an anode made by depositing phosphor compounds on the thin transparent film electrode (R. Meyer, "Recent Development on Microtips Display at LETI", Technical Digest of IVMC, page 6~9, 1991). The display panel can be used as a screen for portable televisions or computer monitors since it is a thin plate less than one centimeter in thickness, and also as a large flat panel screen for HDTV in the future. It is also known that the tip arrays can be applied to sensors for measuring pressure, magnetic fields and vacuums (Juniji Itoh, et al., "Fabrication of Lateral Triode with Comb-shaped Field-Emitter Arrays", Technical Digest of IVMC, page 99~100, 1993).

The cathode tips and the gates of the above micro-triodes can be fabricated by the following conventional method.

First, a silicon dioxide($SiO_2$) pattern is formed on a silicon substrate by the lithography process and then the silicon substrate is etched to a thickness of 7,000~15,000Å. A thermal oxide layer is then formed over the entire surface of the silicon substrate.

Next, a silicon oxide layer and a gate metal layer are sequentially deposited by using an electron beam evaporator and then a cathode tip is formed by lifting-off the portion over the cathode tip (Keiichi Betsui, "Fabrication and Characteristics of Si Field Emitter Arrays", Technical Digest of IVMC, page 26–29, 1993).

Though the conventional lift-off process appears to be a simple one, it has some disadvantages. First, the configurations of the regions surrounding the cathode tips are not entirely uniform since the silicon oxide layer and the gate metal layer thereon are formed mainly by directional deposition using an electron beam evaporator and, thus, such lack of uniformity of the configurations results in uneveness of the array's operation.

Second, the height of the cathode tip relative to the gate is difficult to control because they are dependent on the etched depth of the silicon substrate and the thickness of the silicon oxide layer.

Third, the quality of the silicon oxide layers formed by the electron beam evaporator differs depending on the processing conditions such as the vaccum state, and the temperature of the silicon substrate. These process conditions make it difficult to obtain products of desired specifications during the subsequent processes.

SUMMARY OF THE INVENTION

It is, therefore, an object of the present invention to provide a method for fabricating field emitter arrays which improves the uniformity of such arrays.

Another object of the present invention is to provide a simple, cost-reducing process for manufacturing field emitter arrays.

Still another object of the present invention is to provide a method for manufacturing field emitter arrays, which can improve the symmetry and the uniformity of the configuration surrounding the gates and the cathode tips.

To accomplish the foregoing objects of the present invention, there is provided a method for fabricating silicon field emitter arrays, comprising the steps of: depositing a silicon nitride mask pattern layer on a P-type silicon substrate; forming porous silicon layers of a predetermined depth (1~2 μm) in the silicon substrate except in parts under the silicon nitride mask pattern layer; oxidizing the porous silicon layer to obtain the porous silicon oxide layer and the silicon substrate under the porous silicon layer to make a thermal silicon oxide layer under the porous silicon oxide layer which results in formation of cone shape cathode tips, and exposing cathode tips by etching the silicon nitride mask patterns, the porous silicon oxide layers under the patterns, and the thermal silicon oxide layers under the silicon oxide layer by turns, as will be described hereinafter.

In the present invention, a phosphorus diffused (by use of $POCl_3$), or phosphorous-or arsenic-ion-implanted N-type silicon substrate may be used instead of the P-type silicon substrate. Such diffusion or ion-implantation may be done before or after the silicon nitride mask patterns are formed on the substrate.

BRIEF DESCRIPTION OF THE DRAWINGS

The above objects and other advantages of the present invention will become more apparent by the following detailed description of preferred embodiments thereof with reference to the attached drawings in which.

DETAILED DESCRIPTION OF THE PREFERRED EMBODIMENTS

Hereinafter, the present invention will be described in detail with reference to the accompanying drawings, and in comparison with the conventional method.

Figure 1:
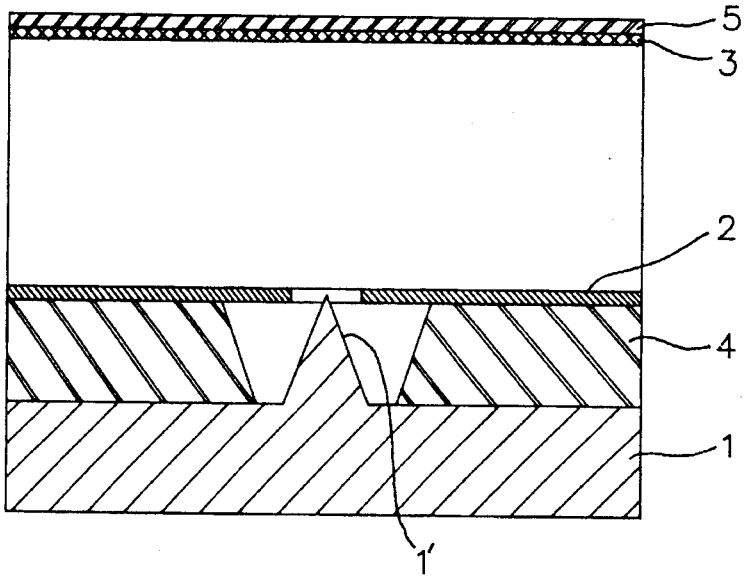
FIG. 1 is a cross-sectional view of a micro-triode.

FIG. 1 is a cross-sectional view of a micro-triode. The micro-triode is comprised of a cathode 1 formed on the silicon substrate, a cathode tip 1', a gate 2, an anode 3, an insulating layer 4 and an anode glass plate 5. A predetermined gap between the anode 3 and the cathode 1 is maintained by a support (not shown). After the packaging is completed, the space between the cathode 1 and the anode 3 is kept in vacuum, and the micro-triode has the same function as a vacuum triode tube.

As shown in FIG. 1, the micro-triodes are manufactured by combining the anodes with the silicon field emitter array, which is comprised of the cathode tips and the corresponding gates thereto formed on the silicon substrate.

Figure 2A:
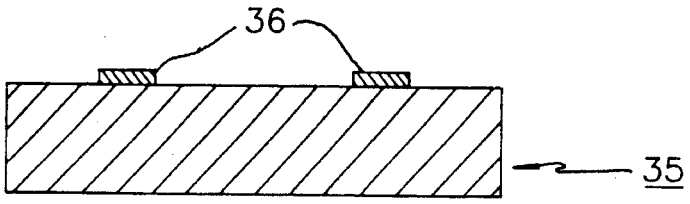
FIGS. 2A–2C are cross-sectional views showing the steps of producing a silicon field emitter array by the conventional lift-off method.
Figure 2B:
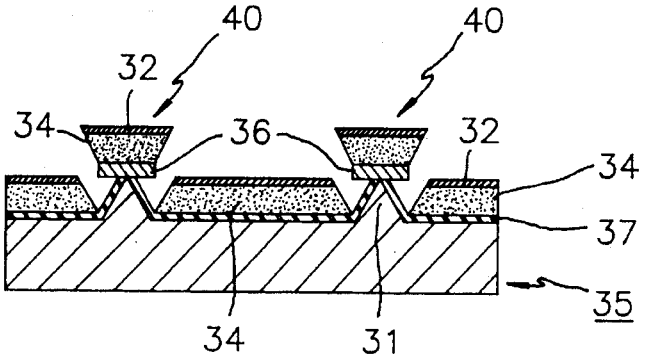
Figure 2C:
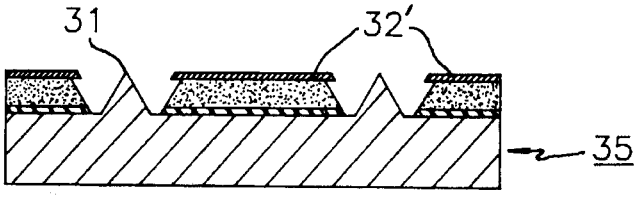

FIGS. 2A to 2C are cross-sectional views showing the steps of manufacturing a silicon field emitter array by a conventional lift-off method, in which a silicon dioxide patterns 36 are masked on a silicon substrate 35 (FIG. 2A). The silicon substrate 35, with exception to the parts under the silicon dioxide patterns 36, is etched to a depth of 7,000~15,000Å and oxidized at a temperature of 900°~1,050° C. Thus, a thermal oxide layer 37 and tips 31 are formed in the silicon substrate 35.

Next, a silicon oxide layer 34 is deposited and then thin metal film layers 32, e.g., chromium, aluminium, nickel or molybdenum, are deposited over the silicon oxide layers 34, to produce islands 40 on the tips 31, each of which is comprised of a thin metal film 32, a silicon oxide layer 34 and a silicon dioxide pattern 36, by using an electron beam evaporator (FIG. 2B).

Thereafter, the thermal oxide layer 37 around the tips 31 are removed by etching and thus the islands 40 are lifted off leaving a silicon field emitter array having tips 31 and gates 32' as shown in FIG. 2C.

The conventional lift-off method is regarded as a simple process. However, the configurations surrounding the cathode tips are different from each other, since the silicon oxide layer and the metal gate layer thereon are formed by directional deposition using an electron beam evaporator. Accordingly, there are problems resulting from the lack of uniformity in the array's operation.

EMBODIMENT 1

FIGS. 3 to 6 are cross-sectional views showing a method for manufacturing a silicon field emitter array according to the first embodiment of the present invention.

Figure 3:
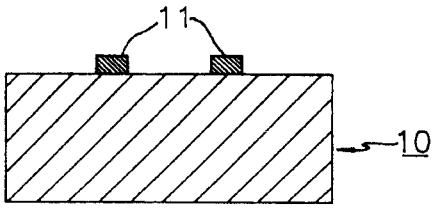
FIGS. 3–8 are cross-sectional views showing the steps of producing silicon field emitter arrays according to the first three embodiments of the present invention.
Figure 4:
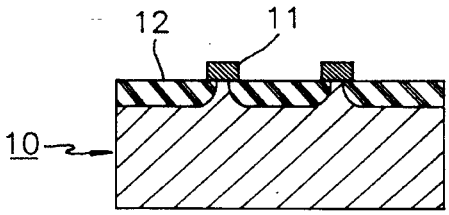

A silicon nitride layer is deposited on a P-type silicon substrate 10 to a thickness of 4,000Å by the LPCVD method and then silicon nitride mask patterns 11 (round-shaped silicon nitride patterns with a diameter of 1 μm, for example) are formed by a photo-lithography process to determine the locations and sizes of individual cathode tips (FIG. 3). Next, the substrate with the patterns 11 is dipped in a hydrofluoric acid solution to which electric power is applied and thus a porous silicon layer 12 is formed to a depth of about 1 μm, for example, onto the silicon substrate, as shown in FIG. 4. In this step, formation of the porous silicon layer 12 moves downwardly on the substrate surface and inwardly at the parts of the substrate 10 under the silicon nitride patterns 11 and thus semi-conical pillars are formed under the silicon nitride patterns 11 (FIG. 4).

Figure 5:
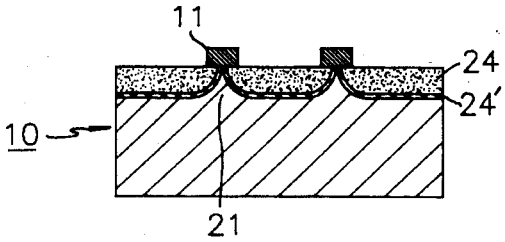

The porous silicon layer 12 is then oxidized at a temperature of 1,000° C., for example, and transformed into a porous silicon oxide layer 24, and a thermal silicon oxide layer 24' of dense microstructure with a thickness of 1,000Å under the silicon oxide layer 24. Resultantly, this process of sharpening by oxidation shapes upwardly-facing conical tips 21 under the silicon nitride patterns 11 (FIG. 5).

The thermal oxide layer 24' acts to reduce leakage current from the cathode to the gate, even when the porous silicon oxide layer 24, as used in the micro-triode, has deteriorated.

In order to use the conical tip 21 as the emitter of a micro-triode, a gate electrode must be provided, having the apex of the tip at the center thereof.

The following refers to the gate formation steps; First, a thin metal film, e.g., molybdenum or tungsten film, with a thickness of 3,000Å is deposited on the porous silicon oxide layer 24 and the silicon nitride mask patterns 11. At this time, photoresist is used to form a pattern on the metal film. Second, gates are formed by removing the metal films on the silicon nitride mask patterns 11 and unnecessary portions of the metal film by means of a photo-etching process.

Figure 6:
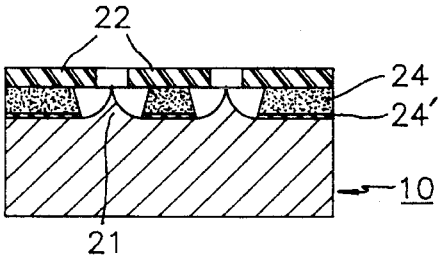

After the silicon nitride patterns are removed, portions of the silicon oxide layer 24 and the thermal oxide layer 24' under the removed patterns 11 are also removed by means of etching with a hydrofluoric acid solution. Then, gates 21 are formed over the corresponding cathode tips 21 according to the conventional processes or processes to be described herein below (FIG. 6).

Consequently, a silicon field emitter array with cathode tips 21 and the corresponding gates 22 is obtained.

EMBODIMENT 2

FIGS. 3, 4, 7, 8 and 6 are cross-sectional views showing a method for manufacturing a silicon field emitter array according to the second embodiment of the present invention.

The reference numerals in the drawings of the second embodiment designate the same elements as those of the first embodiment.

The second embodiment of the present invention is intended to produce a field emitter array with the height of the tip 21 adjusted relative to the corresponding gates 22.

In this embodiment, the same processes of FIGS. 3 and 4 as in the first embodiment are adopted. Then, after the porous silicon layer 12 is formed (FIG. 7), the surface of the porous silicon layer 12 is etched to a predetermined thickness, except for the parts under the silicon nitride mask patterns 11 in order to adjust the height of the tips 21 relative to the gates 22 to be formed during the subsequent steps of FIGS. 8 and 6.

Figure 7:
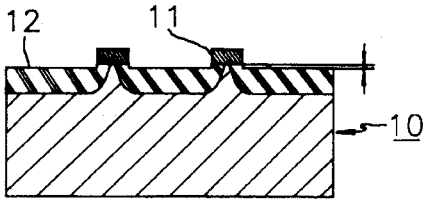
Figure 8:
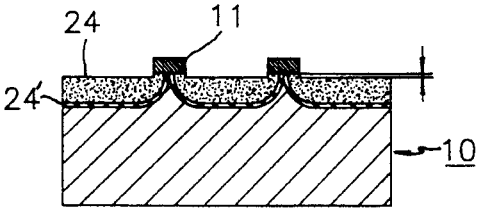

The explanation for the processes of FIGS. 4 and 5 in the first embodiment also applies to that of FIGS. 7 and 8 in this embodiment.

The resultant product of FIG. 8 is then treated according to the step of FIG. 6 and a field emitter array with the height of the tips 21 adjusted relative to the corresponding gates 22 is obtained.

EMBODIMENT 3

FIGS. 3 to 5, 8 and 6 are cross-sectional views showing a method for manufacturing a silicon field emitter array according to the third embodiment of the present invention.

The reference numerals in the drawings of the third embodiment. designate the same elements as those of the first embodiment The third embodiment of the present invention is also intended to produce a field emitter array with the height of the tip 21 adjusted relative to the corresponding gates 22.

In this embodiment, the steps of FIGS. 3 to 5, as in the first embodiment, are adopted. Then, after the porous silicon oxide layer is formed (FIG. 8), the surface of the porous silicon oxide layer 24 is etched to a predetermined thickness, except for the parts under the silicon nitride mask patterns 11 in order to adjust the height of the tips 21 relative to the corresponding gates 22 to be formed in the subsequent step of FIG. 6.

The resultant product of FIG. 8 is then treated according to the step of FIG. 6 and a field emitter array with the height of the tips 21 adjusted relative to the corresponding gates 22 is obtained.

In the second and third embodiments of the present invention, the etched depth of the porous silicon layer 12 and/or the porous silicon oxide layer 24 may be adjusted within a range of 1,000~3,000Å. By doing so, a silicon emitter array having the best possible structure is produced for the lower turn-on voltage of the array and the better current drive of the gates.

In the present invention, the thickness of the silicon nitride layer applied on the silicon substrate is around 1,000~5,000Å and the diameter of the round-shaped silicon nitride mask patterns is about 1~2 μm.

The thickness of the porous silicon layer formed in the silicon substrate is about 1~2 μm and the oxidizing temperature of the porous silicon layer is around 900~1,050° C.

In addition, the thickness of the thermal oxide layer is around 500~2,000Å and the gates can be formed to a thickness of 2,000–4,000Å using aluminium, nickel, tungsten or molybdenum.

EMBODIMENT 4

Figure 9A:
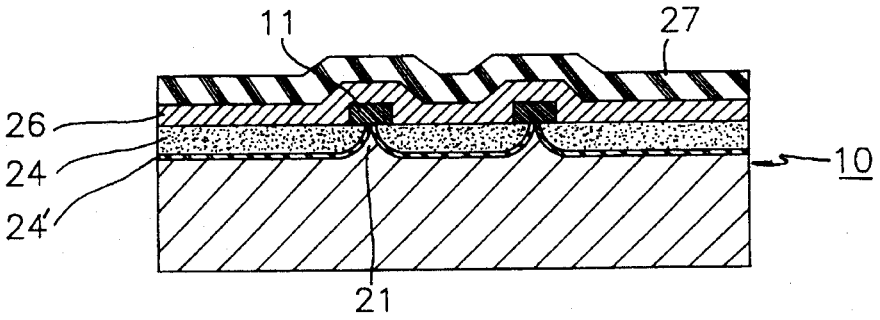
FIGS. 9A–9B are cross-sectional views showing the steps of manufacturing a silicon field emitter array according to the fourth embodiment of the present invention.
Figure 9B:
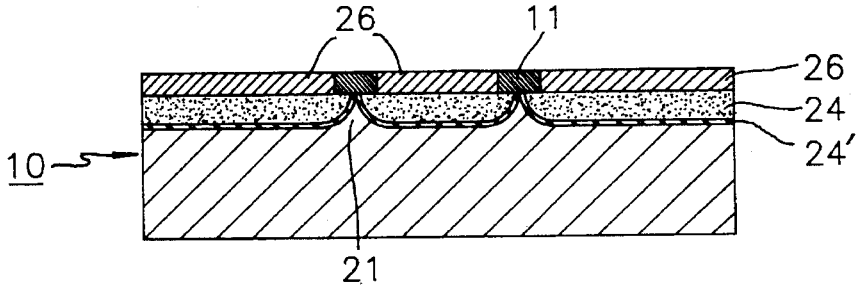

FIGS. 9A and 9B are cross-sectional views to explain a method for manufacturing a silicon field emitter array according to the fourth embodiment of the present invention.

The reference numerals in FIGS. 9A and 9B designate the same elements as those of the first embodiment.

This embodiment of the present invention is to provide a simple process that eliminates the photo-lithography and subsequent etching operations of the foregoing embodiments.

In this embodiment, the steps of FIGS. 3 to 5 as in the first embodiment are adopted. Next, a thin metal film 26, of molybdenum, for example, is deposited to a thickness of 3,000Å by an electron beam evaporator or the sputtering machine and then a photoresist layer 27 is coated on to a thickness of 1–2 μm on the resultant product of FIG. 5. The coated photoresist is thicker in the region that does not have a silicon nitride layer underneath and thinner where the silicon nitride mask patterns are formed, as shown in FIG. 9A.

The photoresist layer 27 is baked and etched bit by bit until the metal films on the silicon nitride mask patterns 11 appear. Thereafter, the metal films 26 on the silicon nitride mask patterns 11 are etched and removed by means of reactive ion etching. Thus, the parts of the metal film which are protected by the photoresist layer 27 are not removed, as shown in FIG. 9B, and remain to perform as the gates.

Thereafter, silicon oxide layer 24 and the thermal oxide layer 24' under the removed mask patterns 11 are sequentially etched and the field emitter array having the tips 21 and the gates 22 is obtained as shown in FIG. 6 of the first embodiment.

EMBODIMENT 5

Figure 10A:
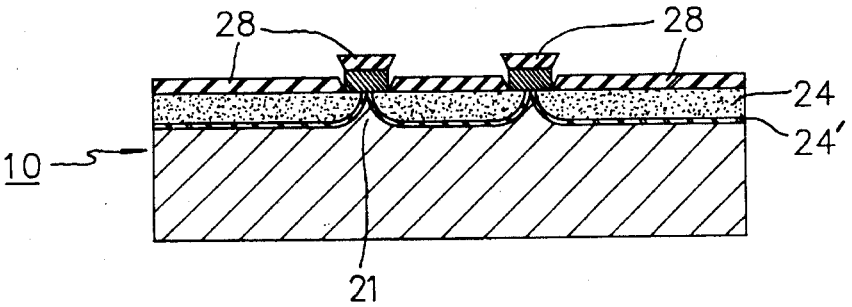
FIGS. 10A–10B are cross-sectional views showing the steps of manufacturing a silicon field emitter array according to the fifth embodiment of the present invention.
Figure 10B:
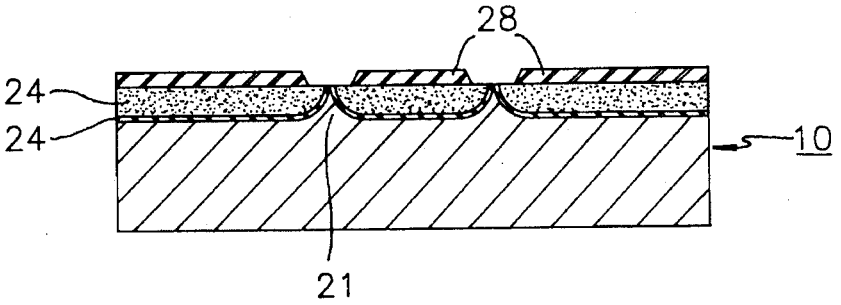

FIGS. 10A and 10B are cross-sectional views illustrating a method for manufacturing a silicon field emitter array according to the fifth embodiment of the present invention.

The reference numerals of the FIGS. 10A and 10B designate the same elements as those of the first embodiment.

In this embodiment, the steps of FIGS. 3 to 5 as in the first embodiment are adopted, with the thickness of silicon nitride layer changed to 5,000Å.

A thin metal film 28, of molybdenum, for example, is then deposited by an the electron beam evaporator as shown in FIG. 10A and the silicon nitride mask patterns 11 are etched by dipping the resultant product in an etchant solution for silicon nitride to lift off the thin rectal film on the silicon nitride layer 11 resulting in the product shown in FIG. 10B.

Thereafter, the porous silicon oxide layer 24 and the thermal oxide layer 24' over the tips 21 are sequentially etched by using a hydrofluoric acid solution and afield emitter array having the tips 21 and the gates 22 is manufactured in the same manner as shown in FIG. 6 of the first embodiment.

The embodiments mentioned above were described using P-type silicon substrates. That is because a porous silicon layer cannot form in N-type silicon substrates in spite of applying voltage to the substrate in a hydrofluoric acid solution.

However, based on the property that a porous silicon layer can be formed in case of a high doping concentration of N-type silicon substrate, a silicon field emitter array can be made from a N-type silicon substrate by phosphorus or arsenic diffusion, or implantation to thereby form an $N^+$layer having a thickness of about 1 μm and a doping concentration of over $10^{18}$ atom/cm$^3$. The specific resistivity of the N-type silicon substrate mentioned above is preferred to be about 1~20 Ω·cm.

Prior to the diffusion or implantation process, a silicon nitride layer pattern is formed on a N-type silicon substrate having the resistivity of about 1~20 Ω·cm, as shown in FIG. 3. A doping step, i.e., ion implantation or diffusion using phosphorus or arsenic, is carried out on the entire surface of the N-type silicon substrate. The phosphorus or arsenic is controlled at a concentration of over $10^{18}$ atoms/cm$^3$. The resulting material is then annealed for post-diffusion process. In post-diffusion step, a gap of about 500~1,000Å between the two separate impurity doped regions under the silicon nitride mask pattern is controlled and thus, have a cross section as shown in FIG. 4.

Thereafter, a field emitter array may be manufactured in the same manner as the foregoing embodiments shown in FIGS. 3~10.

It is expected that pixels are needed to be isolated for applying the field emitter arrays of the present invention to the Field Emission Display(FED).

The following aye steps of ion implantation for such isolation.

Ion implantation of impurities, such as phosphorus or arsenic, is carried out on a P-type silicon substrate having a specific resistivity of about 1~20 Ω·cm(100~150 keV, $10^{14}$~$10^{16}$ ions/cm$^2$), and the resulting material goes through a post-diffusion step to form N-type wells. At this time, the concentration of phosphorus or arsenic is controlled at $10^{18}$~$10^{20}$ atoms/cm$^3$, and the depth of junction is controlled at over 2 μm.

If the field emitter arrays of the present invention, formed with N-type wells in the P-type silicon substrate, are to be used in FED, current flow between one pixel and another should be prevented by applying the lowest possible voltage to the P-type substrate.

In the field emitter array according to the present invention, 3,000~20,000 micro triodes may be integrated per pixel and so, the field emitter display using such arrays is stable on operation, compared with a LCD.

The decrease in the number of masking processes required for the present invention will make it possible to cut down the manufacturing cost of the field emitter arrays and low price field emitter displays will be easily available in the market.

The present invention has been described as for examples, with respect to the preferred embodiments and variations and modifications may be made by one skilled in the art within the scope of the teaching of the present invention. It may be understood that the present invention is not limited by the specific embodiment herein, but shall be limited only by the claims.

What is claimed is:

1. A method for manufacturing a silicon field emitter array, comprising the steps of:

depositing a silicon nitride mask pattern layer as a mask layer on a silicon substrate;

forming a porous silicon layer of a predetermined depth in said silicon substrate except in parts under the nitride mask pattern layer;

oxidizing said porous silicon layer to obtain the porous silicon oxide layer and the silicon substrate under the porous silicon layer to make a thermal silicon oxide layer under said porous silicon oxide layer which results in formation of cone shape cathode tips; and exposing cathode tips by removing said silicon nitride mask patterns, said porous silicon oxide layers under said mask patterns and finally said thermal silicon oxide layers under said removed thermal silicon oxide layers.

2. A method for manufacturing a silicon field emitter array as claimed in claim 1, wherein said silicon substrate is made of P-type silicon substrate.

3. A method for manufacturing a silicon field emitter array as claimed in claim 1, wherein said silicon substrate is made of N-type silicon with a $N^+$-type silicon layer therein which is formed by phosphorus or arsenic diffusion or implantation upto a doping concentration of over $10^{18}$ atoms/$cm^3$.

4. A method for manufacturing a silicon field emitter array as claimed in claim 1, wherein said cathode tips are exposed by means of photo-etching process.

5. A method for manufacturing a silicon field emitter array as claimed in claim 1, further comprising the steps of;

depositing a thin metal film on said silicon nitride pattern layer and said porous silicon oxide layer after said thermal silicon oxide layer is formed; and coating a photoresist layer on said thin metal film;

wherein said cathode tips are exposed by the steps of;

baking and etching said photoresist layer until said metal films on said mask patterns appear;

removing parts of said metal film on said mask patterns by means of etching; and removing said porous silicon oxide layers under said mask patterns and said thermal silicon oxide layer under the removed porous silicon oxide layer by etching process, wherein remaining parts of said metal film form gates.

6. A method for manufacturing a silicon field emitter array as claimed in claim 1, further comprising the steps of;

depositing a thin metal film on said silicon nitride mask pattern layer as well as said porous silicon oxide layer after said thermal silicon oxide layer is formed;

wherein said cathode tips are exposed by the steps of;

etching said silicon nitride mask patterns by a lift-off method using an etchant solution; and removing said porous silicon oxide layers under said mask patterns and said thermal silicon oxide layer under the removed porous silicon oxide layer by etching process, wherein remaining parts of said metal film form gates.

7. A method for manufacturing a silicon field emitter array as claimed in claim 1, wherein before said porous silicon layer is transformed into said porous silicon oxide layer by oxidation, the surface of said porous silicon layer is etched to a predetermined thickness except for the parts under the silicon nitride mask patterns to adjust the height of said tips relative to the gate.

8. A method for manufacturing a silicon field emitter array as claimed in claim 1, wherein after said porous silicon oxide layer is formed by oxidation, said porous silicon oxide layer is etched to a predetermined thickness except for the parts under the silicon nitride mask patterns to adjust the height of said tips relative to the gate.

9. A method for manufacturing a silicon field emitter array as claimed in claim 1, wherein a N-type well is further formed on said silicon substrate to isolate one pixel from another pixel.

* * * * *